United States Patent [19]

Greenberg

[11] Patent Number: 4,554,956

[45] Date of Patent: Nov. 26, 1985

[54] EJECTOR DEVICE AND METHOD FOR PRODUCING SAME

[76] Inventor: Dan Greenberg, 4 Rehov Haganim, Kiryat Bialik, Israel

[21] Appl. No.: 541,060

[22] Filed: Oct. 12, 1983

[30] Foreign Application Priority Data

Oct. 18, 1982 [IL] Israel ..... 67012

[51] Int. Cl.[4] ..... B65B 31/04; B21D 53/00; F16K 1/00

[52] U.S. Cl. ..... 141/65; 29/156.4 R; 29/157 R; 29/157.1 R; 29/417; 137/861; 222/630; 406/153

[58] Field of Search ..... 29/157 R, 157.1 R, 156.4 R, 29/417; 141/65; 222/630; 406/153; 137/861

[56] References Cited

U.S. PATENT DOCUMENTS

| | | | |
|---|---|---|---|
| 3,022,743 | 2/1962 | Engholdt | 29/157 R X |
| 3,106,431 | 10/1963 | Hartley | 29/157 R X |
| 3,331,117 | 7/1967 | Jacobellis | 29/157 R |
| 3,334,401 | 8/1967 | Hopkinson, Jr. | 29/157 R |
| 3,527,502 | 9/1970 | Graham | 406/153 |
| 3,541,657 | 11/1970 | Ellingsen | 29/157.1 R |
| 3,795,348 | 3/1974 | Vertue | 406/153 |
| 3,916,960 | 11/1975 | Thompson | 141/65 X |
| 3,959,864 | 6/1976 | Tell | 29/156.4 R |

FOREIGN PATENT DOCUMENTS

| | | | |
|---|---|---|---|
| 138500 | 10/1981 | Japan | 406/153 |

*Primary Examiner*—Howard N. Goldberg
*Assistant Examiner*—Ronald S. Wallace
*Attorney, Agent, or Firm*—Renner, Otto, Boisselle & Lyon

[57] ABSTRACT

An ejector device which comprises a housing and a number of ejector nozzles positioned in partitions between successive suction chamber is produced by making the housing, producing suction chambers in the latter, forming communication opening between successive chambers, drilling holes through the walls of the housing and the partitions, inserting ejection nozzles into the holes in the partitions, providing flaps to cover the communication opening and closing the housing with a top cover.

8 Claims, 7 Drawing Figures

EJECTOR DEVICE AND METHOD FOR PRODUCING SAME

BACKGROUND AND FIELD OF INVENTION

The present invention relates to a method for producing and constructing an ejector device, and more particularly to such bymeans of which pressurized air is dispensed to pass therein from one ejector nozzle to a subsequent one and so on; whereby the device has a large evacuation capacity in combination with a maximal negative pressure.

There are known a number of such ejector devices, e.g. the one described in U.S. Pat. No. 3,959,864. The advantages of the method of that patent are apparent, but nevertheless there are still some disadvantages in the device according to that patent.

OBJECTS OF THE INVENTION

It is the object of the present invention to overcome these disadvantages, another object of this invention is to provide an ejector device with a better efficiency, a further object is to provide a modular device which can be duplicated or triplicated when a greater negative pressure is needed.

SHORT SUMMARY OF DISCLOSURE

The invention is characterised by a method for producing an ejector device with several ejectors provided in a common ejector housing with an inlet opening for a pressure medium, several ejector nozzles being positioned co-axially in that housing one after the other interconnecting successive suction chambers, one of said chambers being provided with an evacuation inlet port, (as will be defined) the method comprising the steps of producing the housing, forming therein the said suction chambers with substantially quadratic or other rectangular shape, forming communication openings in the partitions between every two successive ones of said suction chambers; drilling holes through the walls of the housing and the partitions between said chambers for accommodation of nozzles, inserting ejector nozzles into said holes, providing valve flaps to cover the said communication openings and thereafter closing the housing by a top cover.

SHORT DESCRIPTION OF DRAWING

The invention will now be described in detail, referring to the annexed drawings in which:

FIG. 1 is a plan view of an ejector device according to the invention, while

DESCRIPTION OF PREFERRED EMBODIMENT

Figure 3:
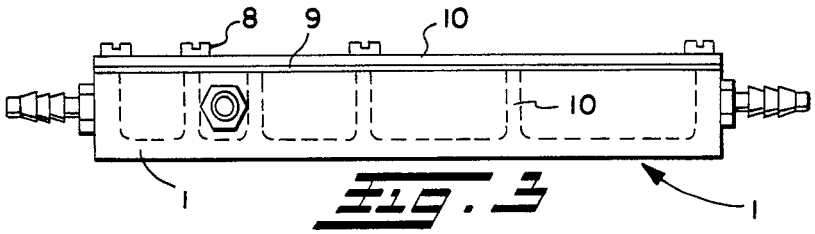
FIG. 3 is an elevational view of the ejector of FIG. 1, and finally
Figure 1:
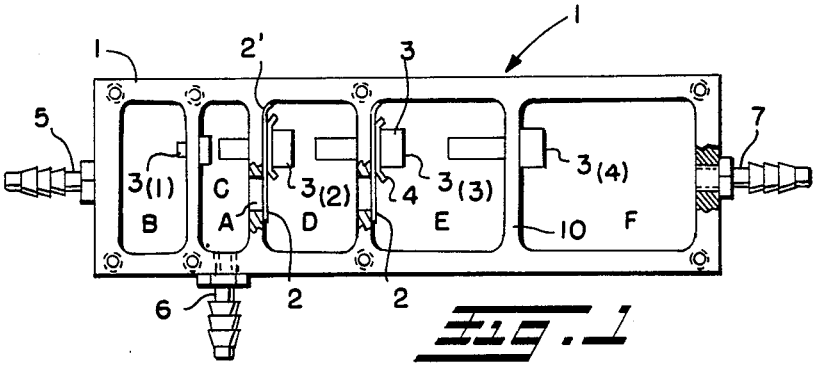
Figure 2:
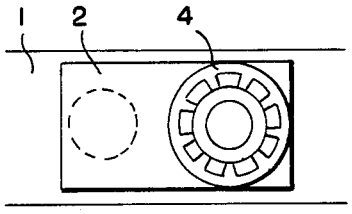
FIG. 2 is an elevational, fractional view of one of the partitions between individual suction chambers.

Turning first to FIGS. 1 and 3, the new ejector device comprises a housing, generally indicated by reference numeral 1. In the example shown there are provided a number of chambers B, C, D, E, F partitioned from one another by partitions 10. The casing and the said partitions may be produced as an integral body, e.g. by moulding—if the ejector is made of plastics—or by electroerosion—if made of metal. Nozzles 3 are fixedly inserted in holes drilled in the partitions 3.

In the partitions 10 apertures A are also provided which are covered by elastic flaps 2 at one side of the partition, thus permitting passage of air or gas in one direction only. The flaps 2 are held in position by means of the nozzles 3 in such a manner that one end of said flaps 2' is slightly bent into the corner of each chamber.

The chambers B, C, D, E and F are subject to different sub pressure values, as will be explained.

The inlet into the housing 1, i.e. into chamber B is the pressure inlet 5, while an outlet 7 leads from chamber F.

The nozzles 3, which, as has been stated, are fixed in the partitions 10 are arranged co-axially.

An inlet 6 leads into Chamber C and is connected via a conduit to the container from which air is to be ejected and a vacuum created.

The ejector so far described operates in the following way: Inlet 5 is connected to a source of pressurized air, for example a compressor. Pressurized air (or another fluid) is pressed into chamber B, it will stream out through the nozzle 3 into chamber C and through the next co-axial nozzle into chamber D and so on. The air stream will take along air from the chamber it passed so that the initial pressurized air together with the air brought with it will stream out through the outlet 7. Thus air quantity will increase through the nozzles from ejector to ejector, consequently the sub pressure in the chamber will increase in succession from one chamber to the next one. When the sub pressure in chamber D is lower than in chamber C air will flow from chamber C to chamber D through aperture A since it can only flow in the direction towards outlet 7. The only connection into the chambers is through chamber C which has the inlet 6, i.e. said inlet acts as a suction inlet.

As can be seen in FIG. 1, the distance between co-axial nozzles increases in the direction of flow and so does the diameter of the individual nozzles, a matter which is a subject to the efficiency degree to be obtained.

Figure 4:
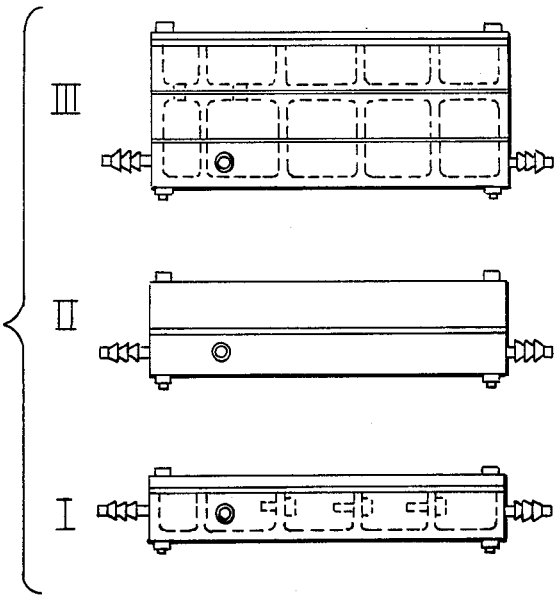
FIG. 4 (I, II and III) illustrate several possibilities of modularly combining ejectors into multiple units.

With the above description in mind the arrangement of FIGS. 4I, II and III will be clear. While in FIG. 4(I) an ejector device as described is shown with an added, flexible cover 12, according to FIG. 4(II) a second ejector device II is placed upside down on the ejector device I with interposition of cover 12 in which a hole has been provided establishing communication between the two chambers C of the two superposed ejector devices.

According to FIG. 4(III) a third ejector device III is used, in which case appropriate openings are made in the top of ejector device II and the bottom of ejector device III which is provided with a cover 13.

I claim:

1. A method for producing an ejector device with plural ejector chambers provided in a common ejector housing having inlet and outlet ports for a pressure medium and an evacuation inlet port communicating with one of the chambers, and plural ejector nozzles positioned coaxially in respective housing partitions separating relatively adjacent ejector chambers for interconnecting such chambers, said method comprising the steps of:

producing the housing with ejector chambers of substantially rectangular shape being formed therein in a coaxial and successive arrangement with adjacent chambers being separated by a respective common transverse partition;

forming communication openings in the transverse partitions between adjacent chambers;

drilling holes through end walls of the housing and co-axial holes through the transverse partitions between adjacent chambers for accommodation of ejector nozzles;.

inserting ejector nozzles into the holes in respective transverse partitions;

installing valve flaps to cover respective communication holes;

closing the housing by securing and sealing with a top cover; and providing at respective operative positions in the housing pressure medium inlet and outlet ports in communication with respective different chambers and an evacuation inlet port in communication with one of the chambers.

2. The method of claim 1, further comprising the step of angularly bending the valve flaps to lie against two walls of a chamber which walls define a corner of such chamber.

3. The method of claim 1, wherein said nozzle inserting step includes placing the nozzles co-axially with the distances between adjacent nozzles increasing in the direction of flow of pressure medium through the ejector device.

4. The method of claim 1, wherein said housing producing step includes forming the housing with only one open side, and said closing step includes using a single top cover to close such open side of the housing.

5. The method of claim 1, wherein said housing producing step includes forming the housing by molding or electro-erosion.

6. The method of claim 1, wherein said housing producing step includes forming the housing with one side of each ejector chamber opening to a common side of the housing, and said closing step includes closing the open side of each chamber by sealing with a common top cover.

7. The method of claim 1, wherein said valve flap installing step includes securing the valve flaps to respective nozzles.

8. An ejector device made in accordance with the method of claim 1.

* * * * *